US005890304A

United States Patent [19]

Jurisch et al.

[11] Patent Number: 5,890,304

[45] Date of Patent: Apr. 6, 1999

[54] DEVICE FOR LIFTING, LOWERING AND LEVELING BOOMS OF STRIP MINING EQUIPMENT

[75] Inventors: Horst Jurisch, Grünewalde; Burghard Petack, Senftengerg; Jürgen Zeidler, Lauchhammer, all of Germany

[73] Assignee: Man Takraf Fördertechnik GmbH, Leipzig, Germany

[21] Appl. No.: 736,932

[22] Filed: Oct. 25, 1996

[30] Foreign Application Priority Data

Nov. 9, 1995 [DE] Germany ..... 195 41 867.0

[51] Int. Cl.[6] ..... E02F 3/24

[52] U.S. Cl. ..... 37/190; 37/91; 198/316.1

[58] Field of Search ..... 37/190, 189, 462, 37/463, 91, 92, 93, 94, 95, 96, 97; 299/76, 34.7; 198/307.1, 509, 316.1, 318, 861.5; 414/435, 436

[56] References Cited

U.S. PATENT DOCUMENTS

| | | | |
|---|---|---|---|
| 3,645,020 | 2/1972 | Belsin et al. | 37/91 |
| 3,744,615 | 7/1973 | Plaquet et al. | 198/316.1 X |
| 4,206,840 | 6/1980 | Hanson | 198/316.1 X |
| 4,542,940 | 9/1985 | Marten | 299/39.3 X |
| 4,871,281 | 10/1989 | Justice | 37/353 X |
| 5,247,743 | 9/1993 | Holloway et al. | 37/462 X |

FOREIGN PATENT DOCUMENTS

| | | |
|---|---|---|
| 31 02 715 C2 | 2/1985 | Germany . |
| 279 037 | 8/1993 | Germany . |

*Primary Examiner*—Tamara L. Graysay
*Assistant Examiner*—Thomas A. Beach
*Attorney, Agent, or Firm*—McGlew and Tuttle

[57] ABSTRACT

A level boom is provided for a piece of strip mining equipment traveling on caterpillar-type chassis, which piece of equipment is temporarily moved on oblique roadways during operation. The position of the boom in relation to the skeletal structure is corrected with simple means. A piece of strip mining equipment with a boom, which can be lifted and lowered and at the free end of which, e.g., a bucket wheel for picking up a load is arranged, is connected to the substructure of the piece of equipment in a pivot axis. The lifting movement is brought about by a lifting cylinder. A tilting support, which carries the boom, is arranged in the pivot axis for lifting and lowering the boom. A bolt connection is provided on one side in the pivot axis for leveling between the tilting support and the boom, and the actuating element for leveling as well as a step bearing for absorbing lateral forces which the actuating element is unable to absorb, are located on the other side. Since the actuating element for lifting and lowering the boom is arranged in the pivot axis for leveling, no additional support elements are needed.

3 Claims, 4 Drawing Sheets

DEVICE FOR LIFTING, LOWERING AND LEVELING BOOMS OF STRIP MINING EQUIPMENT

FIELD OF THE INVENTION

The present invention pertains to a device for lifting, lowering, and leveling of booms of strip mining equipment according comprising joints and linear actuating elements.

BACKGROUND OF THE INVENTION

It is especially suitable for the use of caterpillar-type bucket wheel excavators on roadways with differently sloped planes in the direction of travel. The present invention is also suitable for use in transfer equipment, e.g., combined stacker-reclaimers. It has been known that the substructure and the superstructure are leveled in relation to the chassis in bucket wheel excavators which temporarily operate, in relation to the direction of travel of the equipment, in the oblique position during the pickup of the load. It is possible due to this leveling, e.g., to efficiently mine oblique layers, and favorable conditions are created for the ability to function and the stability of the equipment.

The technical means for leveling are arranged in the prior-art solutions between the frame of the chassis and the ring support belonging to the substructure. According to DD 279 037, it comprises mainly a cardan joint on the side of one caterpillar support and two devices for ensuring adjustability in height on the side of the other caterpillar support. Since the entire load of the device is introduced onto the chassis via these assembly units, it is necessary to design these assembly units as robust units. The special design of the cardan joint as well as of the vertical guides and of the means for compensating movements require technically and technologically expensive solutions.

This is remedied by the present invention.

SUMMARY AND OBJECTS OF THE INVENTION

The primary object of the present invention is therefore to provide a device for leveling booms of strip mining equipment in the manner described in the introduction, which is of a simple design and guarantees reliable function. It shall be arranged between the fixed superstructure and the pivotable boom.

According to the invention, a device for lifting, lowering and leveling booms of strip mining equipment is provided including joints and linear actuating elements. The boom is supported in three points in relation to a fixed skeletal structure and is pivotable around both a horizontal pivot axis for a lifting movement and about an axis at right angles to a direction of travel of the equipment, for a leveling movement. These movements take place independently from one another and without mutually affecting each other. One drag bearing is provided in a pivot axis for lifting and lowering of the boom and is formed by bolts which are mounted in the skeletal structure and accommodate a tilting support with the boom. A linear actuating element is provided between the skeletal structure and the boom for pivoting the boom at a spaced location from the pivot axis in the area of the pivot axis for the leveling movement. A bolt is arranged as a connection between the tilting support and the boom in the pivot axis for the leveling movement. A linear actuating element for leveling the lateral slope support, which holds the boom in its longitudinal direction in a positive locking manner and thus absorbs lateral forces and permits a displaceability at right angles thereto for leveling, are provided as a second connection of the boom to the tilting support in the pivot axis for lifting and lowering the boom on the other side of the tilting support.

Both the lifting and lowering of the boom of strip mining equipment and leveling by compensation of the lateral slope are made possible by the present invention in a simple manner with a few additional means. The two movements are performed independently from one another and without mutually affecting each other.

The individual supports and actuating elements predominantly assume a dual function. Thus, the linear drives are at the same time actuating elements for the pivoting movement (lifting and lowering) of one type of movement and also supports for absorbing the forces acting on the substructure in the direction of the piston rod, and the support with the bearing bolt arranged in the manner of a cardan joint permits pivoting of the boom for both lifting and lowering the pick-up member and for compensating its lateral slope.

A lateral force support is preferably provided comprising two two-dimensional parallel guides. The guides are connected to the boom either directly or via a frame. The guides surround the tilting support from two sides such that a positive locking connection is formed in the longitudinal direction of the boom and lateral forces can thus be absorbed, and linear displaceability is permitted in a direction of action of the actuating device for leveling, and the tilting support is provided with sliding surfaces in the area of the positive locking connection and the guides are provided with sliding blocks for engaging the sliding surfaces. The actuating element for the lateral slope compensation is preferably actuated automatically for leveling by a leveling device.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
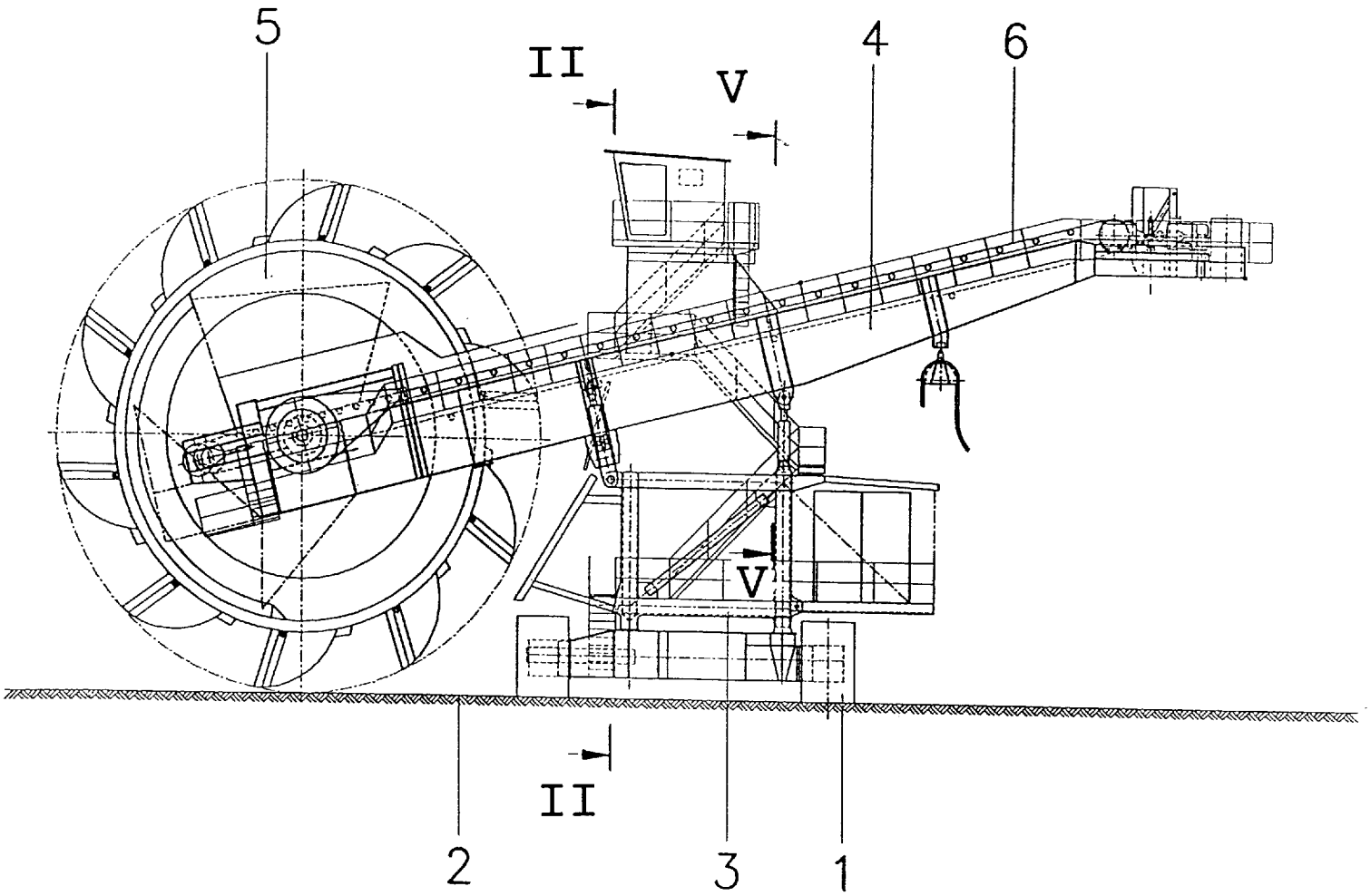
FIG. 1 is a side view of a bucket wheel excavator with adjustability of the bucket wheel boom around two pivot axes.

The bucket wheel excavator shown in the drawing is designed without slewing gear and is intended for operation on waste dumps. The bucket wheel boom is pivotable around a horizontal axis 8, so that the pick-up member is able to perform an arc-shaped feed motion limited between an upper point and a lower point. Due to the special conditions of use, which arise from storage concerning the removal of stored material, it is necessary to move the equipment both on a level roadway and alternately on a roadway 2 sloped at an angle α during the pick-up of the load on the traveling substructure, the caterpillar-type chassis 1. The consequence of this is that conditions which are disadvantageous for the function of the equipment will arise when a defined slope is exceeded. The equipment is therefore equipped with means for compensating the lateral slope for leveling the pick-up member for the load. These means are arranged between the fixed superstructure and the bucket wheel boom that is pivotable (can be lifted and lowered).

Figure 2:
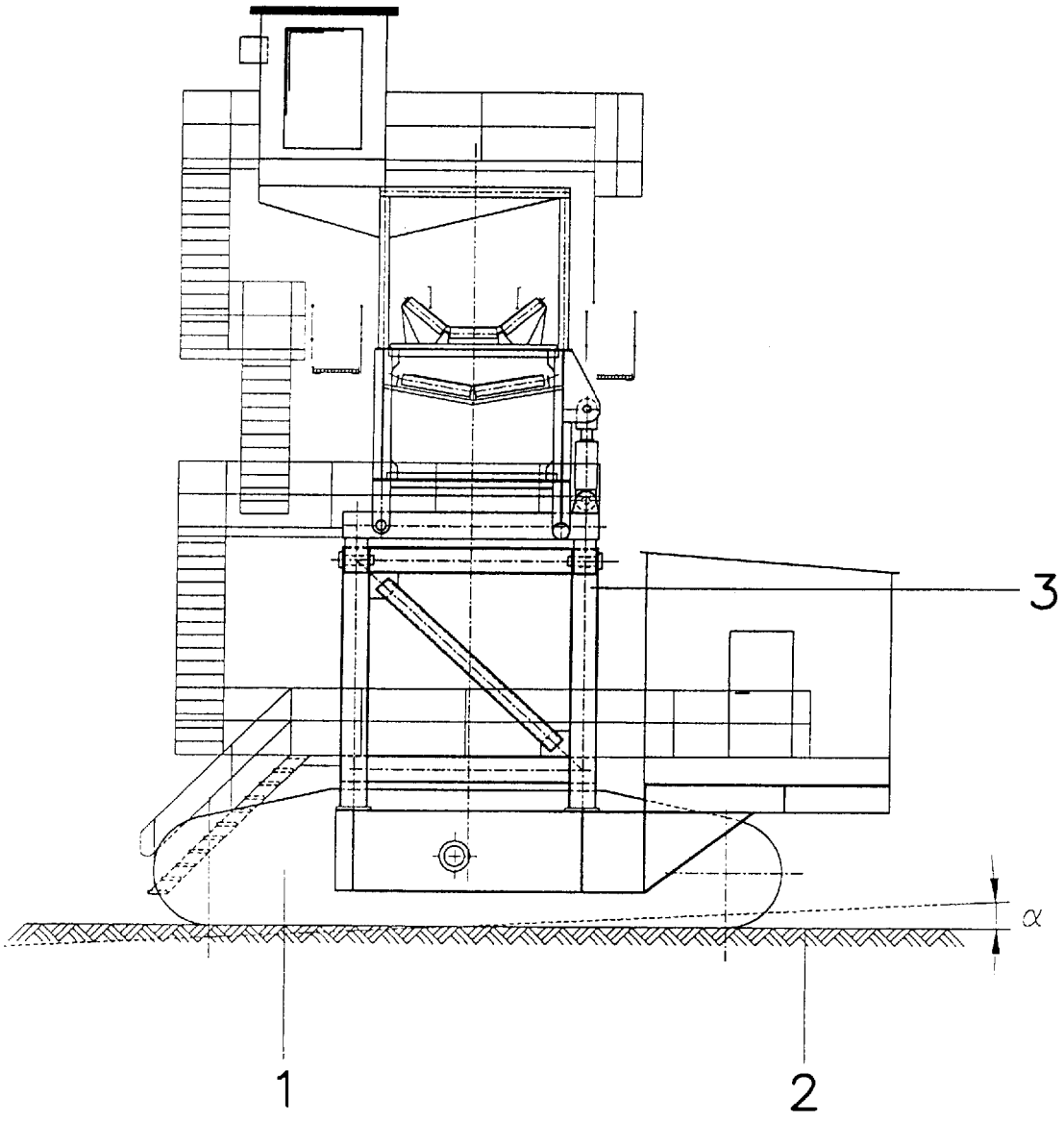
FIG. 2 is a sectional view taken along line II—II according to FIG. 1.

FIGS. 1 and 2 show the basic design of the equipment. The caterpillar-type chassis 1 belongs to the traveling fixed substructure, and the skeletal structure 3 belongs to the fixed superstructure. The bucket wheel boom 4 with the bucket wheel 5 and with the removing conveyor 6 are arranged on the skeletal structure 3.

Other details, such as drives, machine housing, operator's stand, and possibilities of access for the operating and maintenance personnel, are also shown in the drawing. They do not have to be discussed in detail below, because they are irrelevant for the representation of the present invention and for the description of its function.

The bucket wheel boom 4 can be moved by the actuating cylinder 7 around its pivot axis 8. As a result, the bucket wheel 5 performs a lifting movement necessary for picking up the bulk material.

The leveling of the boom 4 with the bucket wheel 5 in relation to the slope of the roadway 2 at the angle α is brought about by pivoting the bucket wheel boom 4 around a pivot axis 9 extending at right angles to the direction of travel of the equipment. This pivot axis 9 is located in the area of the left-hand top edge of the skeletal structure 3 in the drawings according to FIGS. 2 and 3. The pivot axis 8 for the lifting movement and the pivot axis 9 extending at right angles to the direction of travel for the slope compensation in the case of an oblique roadway 2 form a right angle with one another in the top view.

This pivot axis 9 extending at right angles to the direction of travel for leveling, and the pivot axis 8 extending in parallel to the direction of travel for lifting and lowering the bucket wheel boom require a special design of the assembly units affected by them. Thus, a tilting support 10 is arranged in the area of the pivot axis 8, and it is connected to the skeletal structure 3 by bolts 11 on both sides. The gantry-like frame 12 rigidly connected to the bucket wheel boom 4 is supported on both sides on the tilting support 10. One support is a bolt connection 13 for leveling at right angles to the pivot axis 8 for lifting and lowering. The second support is a linear actuating element 14 designed as a lifting cylinder, which is connected with its eye in the cylinder foot by a bolt 15 at right angles to the pivot axis 8 for lifting and lowering the bucket wheel boom 4 and with its eye in the piston rod head by another bolt 16 in parallel to the pivot axis 9 for leveling the bucket wheel boom 4.

To bring about the movement around the pivot axis 9, which is associated with the lateral slope compensation of the bucket wheel boom 4, both the cylinder eye and the eye in the piston rod head are provided with a drag bearing each.

This lifting cylinder 14 may be controlled either manually or automatically by a leveling device.

Figure 4:
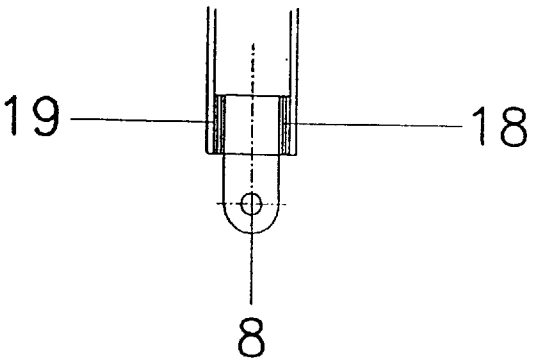
FIG. 4 is a sectional view taken along line C—C according to FIG. 3.
Figure 3:
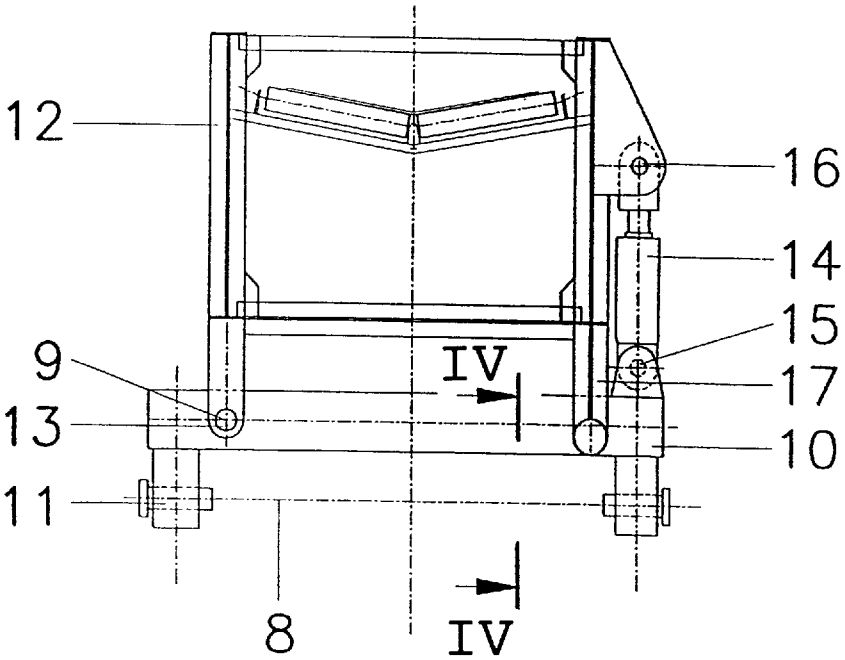
FIG. 3 is an enlarged schematic view of the mounting of the bucket wheel boom in the pivot axis for the compensation of the lateral slope according to FIG. 2.
Figure 5:
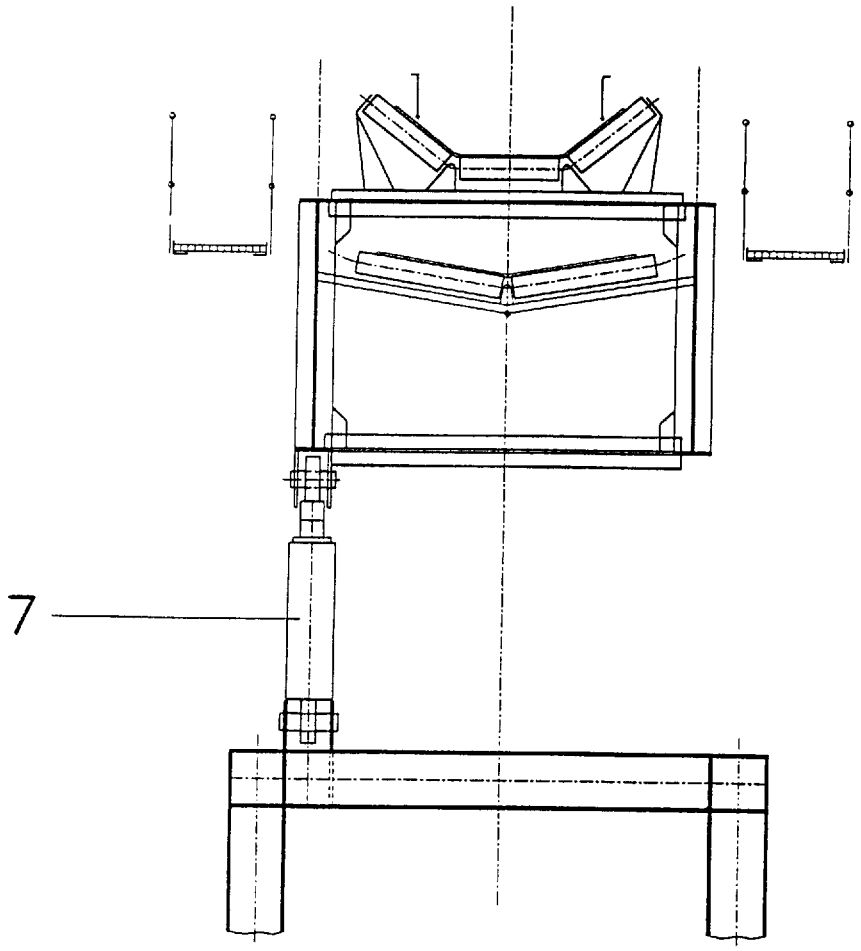
FIG. 5 is a sectional view taken along line V—V according to FIG. 1 with the arrangement of the cylinder for the lifting movement of the bucket wheel boom.

Since the actuating element 14 is unable to absorb horizontal forces which occur, a lateral force support is necessary according to FIGS. 3 and 4. The actuating element 14 arranged in the area of the second free foot of the gantry-like frame 12 is provided for this purpose with two straight, parallel and two-dimensional extensions 17, which are located opposite each other and surround the tilting support 10 from two sides such that a linear movement is achieved for leveling, and the forces acting in the longitudinal direction of the bucket wheel boom 4 can be absorbed. The area of the tilting support 10 in question is provided with sliding surfaces 18 for this purpose. The parallel extensions 17 are equipped with sliding blocks 19 opposite these sliding surfaces 18. This lateral force support thus makes possible a longitudinal movement for leveling and absorbs the lateral forces acting on the sliding surfaces 18.

If the bucket wheel excavator is in use on flat terrain, the actuating cylinder 14 for the lateral slope compensation assumes a middle position. A locking device, by which the boom 4 is held in this starting position, may also be provided in this position. If the position of the bucket wheel excavator changes, a correcting movement is triggered by the operating personnel or by an automatically operating leveling device when a lateral slope of a defined value is exceeded until the boom 4 with the bucket wheel 5 has reached its desired position. This process is repeated in the case of a further change in position. Regardless of this, the lifting movement of the bucket wheel boom 4 necessary for picking tip the load can be performed.

While a specific embodiment of the invention has been shown and described in detail to illustrate the application of the principles of the invention, it will be understood that the invention may be embodied otherwise without departing from such principles.

What is claimed is:

1. A device for lifting, lowering and leveling boom of traveling strip mining equipment, comprising:

a skeletal structure; and boom support means for supporting the leveling boom in relation to said skeletal structure and for pivoting the leveling boom around both a horizontal pivot axis for a lifting movement and a leveling pivot axis at a right angle to the direction of travel of the equipment for a leveling movement, said lifting movement taking place independently from said leveling movement and without said lifting movement affecting said leveling movement and without said leveling movement affecting said lifting movement, said boom support means including a tilting support carrying the leveling boom, bolts mounted to said skeletal structure and connected to said tilting support, a lifting linear actuating element for effecting said lifting movement provided between said skeletal structure and the leveling boom for pivoting said boom, said linear actuating element being at a spaced location from said horizontal pivot axis adjacent to an area of said leveling pivot axis for the leveling movement, a bolt arranged as a first connection between said tilting support and the leveling boom, said bolt being disposed at said leveling pivot axis, and a leveling linear actuating element for leveling and providing lateral slope support, said leveling linear actuating element holding said boom in its longitudinal direction in a positive-locking manner and thus absorbing lateral forces and permitting a displaceability at right angles thereto for the leveling, provided as a second connection between the leveling boom and said tilting support at said horizontal pivot axis for lifting and lowering the said boom on another side of said tilting support.

2. A device for lifting, lowering and leveling boom in accordance with claim 1, further comprising: a frame disposed between said leveling boom and said tilting support and a force support formed of two two-dimensional, parallel guides connected either to the leveling boom directly or to the leveling boom via said frame, said guides surrounding said tilting support from two sides to form a positive-locking connection formed in a longitudinal direction of the leveling boom whereby lateral forces can thus be absorbed, and linear displaceability is permitted in a direction of action of said linear actuating device for leveling, and said tilting support is provided with sliding surfaces in an area of said positive-locking connection, and the said guides are provided with sliding blocks engaging said sliding surfaces.

3. A device for lifting, lowering and leveling booms in accordance with claim 1, wherein said leveling linear actuating element for the lateral slope compensation is actuated automatically for leveling by a leveling device.

* * * * *